United States Patent [19]

Wilmarth

[11] 4,397,462

[45] Aug. 9, 1983

[54] PNEUMATIC EXERCISING DEVICE

[76] Inventor: Russell F. Wilmarth, 185 Oakdale Ave., Manchester, N.H. 03103

[21] Appl. No.: 277,930

[22] Filed: Jun. 26, 1981

[51] Int. Cl.[3] ..... A63B 21/00

[52] U.S. Cl. ..... 272/130; 272/134

[58] Field of Search ..... 272/130, 129, 134, 144, 272/93; 128/25 R

[56] References Cited

U.S. PATENT DOCUMENTS

| | | | |
|---|---|---|---|
| 3,128,094 | 4/1964 | Wolf | 272/130 |
| 3,369,403 | 2/1968 | Carlin | 272/130 X |
| 3,387,843 | 6/1968 | Chandler | 272/130 |
| 3,451,271 | 6/1969 | Knoblauch | 272/130 |
| 3,861,677 | 1/1975 | Wheeldon | 272/130 |
| 3,984,102 | 10/1976 | Evans | 272/130 |
| 4,184,675 | 1/1980 | Rogerson | 272/130 |
| 4,241,913 | 12/1980 | Zwayer | 272/130 |
| 4,257,593 | 3/1981 | Keiser | 272/130 |
| 4,275,882 | 6/1981 | Grosser | 272/130 |

*Primary Examiner*—Richard J. Johnson

*Attorney, Agent, or Firm*—Lee A. Strimbeck

[57] ABSTRACT

A pneumatic exercising device uses a lever arm operated by the exerciser which works against a pneumatic cylinder. The pneumatic cylinder is connected to a much larger reservoir, the pressure in which can be adjusted as desired by means of an auxiliary pump. The reservoir is contained in one of the support members for the exercise device. A preferred embodiment is a bench press wherein the height of the lever arm above the bench is adjustable by setting the height of the lever arm fulcrum on a vertical support therefor, which vertical support is hollow and contains the air reservoir, the pneumatic cylinder being connected thereto by a length of flexible hose. The air reservoir is preferably sized so that the pressure remains essentially constant as does the force offered by the lever arm.

6 Claims, 2 Drawing Figures

PNEUMATIC EXERCISING DEVICE

PRIOR ART

See U.S. Pat. No. 4,257,593 and the references cited therein for examples of pneumatic exercising devices. The present invention is to be distinguished from hydraulic devices wherein the exercising force is generated or controlled by the flow of a liquid through an orifice, as in U.S. Pat. Nos. 3,451,271; 3,861,677 and 4,257,593. In the present invention the exercising force results from working against the pressure offered by a compressible gas.

THIS INVENTION

The present invention is a pneumatic exercising device using a lever arm operated by the exerciser which works against a pneumatic cylinder.

An object of the present invention is to provide a pneumatic device that simulates the effect given by conventional weight lifting without the use of dead weights. Another object of this invention is to provide an integral pneumatic exercising device having an operating pneumatic cylinder with a piston and piston rod, which is connected to a reservoir quite substantially larger in capacity than the displacement of the pneumatic cylinder. Preferably the reservoir is an integral part of the supporting frame or stand of the exercising device. Another object is to provide a dynamic exercising device wherein the force offered to the exerciser remains essentially constant over the stroke of the exerciser's effort.

THE DRAWINGS

Other objects and advantages of this invention will become apparent from the following description made with reference to the drawings illustrating one preferred embodiment of the invention, viz., a bench press, in which drawings.

DESCRIPTION

Figure 2:
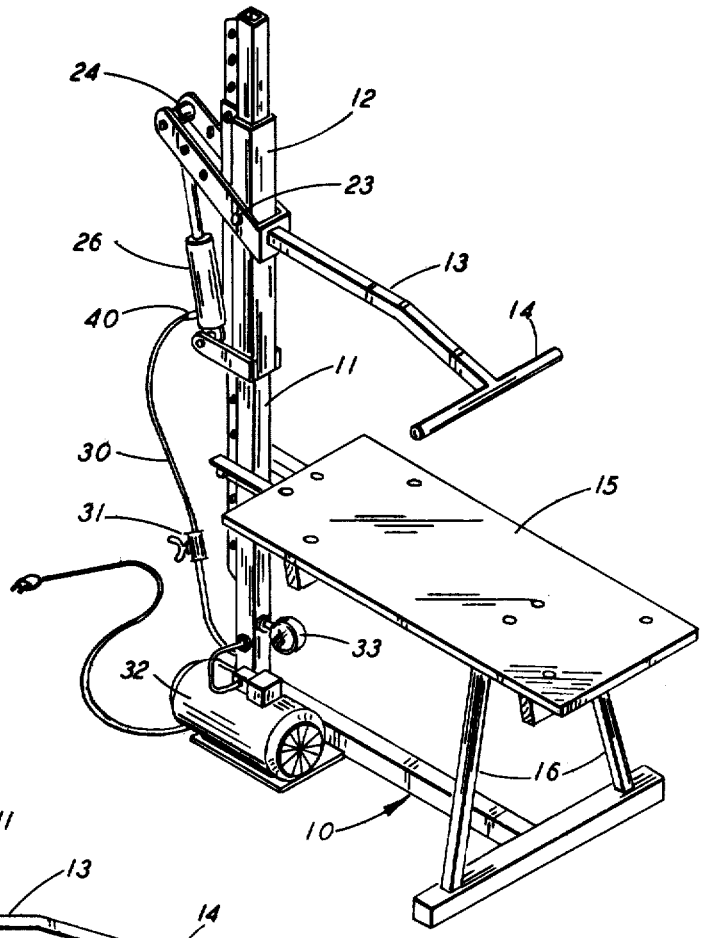
FIG. 2 is a perspective view.
Figure 1:
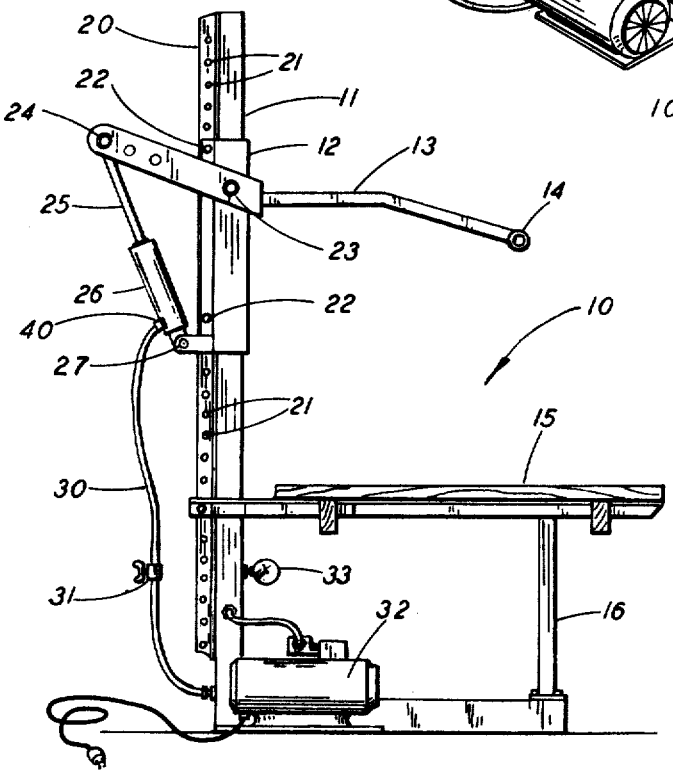
FIG. 1 is a side elevational view of the bench press.

In brief compass, the present invention is a pneumatic exercising device comprising:

A. A frame having an elongated support member and having one portion thereof hollow and providing an airtight reservoir integral with the frame;

B. A fulcrum supported by the elongated support member and adjustable in position along the length thereof;

C. A lever arm mounted to the fulcrum for rotation thereabout in a plane of the axis of the elongated support member;

D. A pneumatic cylinder, including a piston and piston rod, one end of which cylinder is pivotally mounted to the lever arm and acts thereagainst, and E. A length of flexible conduit connecting the compression side of the pneumatic cylinder with the reservoir.

Preferably, the reservoir has a capacity which is at least 30 times that of the displacement of the pneumatic cylinder.

Also, the exercise device preferably has associated with it an air compressor that can supply compressed air to the air reservoir and regulate the pressure therein.

The air reservoir can have a gauge to show the pressure therein, which can be calibrated to indicate the force in pounds or kilograms offered by the lever arm.

The pneumatic cylinder is preferably double acting such that by simply turning a valve the force offered by the device can be reversed, i.e. the lever arm handle can be either pulled upon or pushed upon depending on the position of the pneumatic cylinder valve.

By making the air reservoir many times larger than the displacement of the pneumatic cylinder, the pressure in the reservoir and thus in the pneumatic cylinder remains essentially constant over the stroke of the cylinder, and thus the force offered by the cylinder remains essentially constant. In another embodiment of the invention the size of the reservoir can be made smaller relative to the displacement of the pneumatic cylinder, such that as the stroke progresses the pressure in the reservoir will increase substantially as will be the force offered to the exerciser.

The drawings illustrate a preferred embodiment of the invention—a bench press. The stand is generally indicated at 10 and has a vertical support 11 which carries the fulcrum 12 for the lever arm 13 which the exerciser operates by means of handle 14.

The stand 10 supports a conventional bench 15 which has legs 16.

The rear portion of member 11 has an elongated vertical guide 20 thereon perforated with holes 21 to receive locking pins 22, which pass through the rear portion of fulcrum 12, which rear portion has a channel matching with guide 20 and appropriate holes to receive pins 22. Pins 22 can be removed at will by the user and fulcrum 12 can be slid up and down member 11 to the desired height and the pins reinserted.

Lever arm 13 is pivoted on fulcrum 12 at 23 and ends with a cross-member 24, which is connected to the piston rod 25 of pneumatic cylinder 26. The other end of pneumatic cylinder 26 is mounted on the back side of fulcrum 12 at 27. Thus, as handle 14 is pushed upward by the exerciser, cross-member 24 descends, causing pneumatic cylinder 26 to compress. If desired, the point 24 connecting the lever arm to the cylinder can be made adjustable so that the stroke and displacement of the cylinder can be changed.

Optionally, the pneumatic cylinder can be on the same side of the fulcrum point as handle 14, e.g., see the lever arm/piston/fulcrum illustrated in U.S. Pat. No. 3,128,094 (FIG. 3).

The compression side of pneumatic cylinder 26 is connected by a flexible length of tubing 30 to the air reservoir contained in member 11. The operation of pneumatic cylinder 26 can be used to build up and control the pressure in the air reservoir by operation of a suitable check valve 31 which can be placed as shown in line 30 or elsewhere as may be convenient. Also, valve 31 can be a multi-position valve and can be used to bleed the reservoir.

Preferably, however, an electric pump or air compressor 32 is connected to the air reservoir such that the pressure in the reservoir can be build up rapidly and be more readily controlled. A suitable gauge 33 is connected to the reservoir so that the user can determine the pressure contained therein and the force offered by the machine.

Preferably the air reservoir or accumulator contained within tubing 11 has a capacity of at least 750 cubic inches, e.g., 1000, and the pneumatic cylinder has a displacement of less than 25 cubic inches, e.g. 18. Alternatively, the air reservoir can be sized to effect an increase in force offered. For example, two reservoirs in series can be used of 200 and 800 cubic inch capacity and connected by a valve. For an 18 cubic inch displacement piston, if both are available, the percentage increase in force for a full stroke is only an insignificant 1.8%, but if only the 200 cubic inch reservoir is made available, then the force will increase 9% over the stroke. This is assuming constant temperature, which will not necessarily be true, as there will be some temperature rise and the increased effort may be 10% or slightly more.

Variations in the application of the principles of this invention will be appreciated by the skilled in the art. Pneumatic cylinder 26, instead of being connected to a lever 13, can instead be connected to a cable, preferably through a gearing arrangement, so as to offer resistance to a pulling force on the cable. Alternatively, hose 30 can have a quick release attachment as at 40 so that it may be attached to a like cylinder of a hand held exercising device, as for pectoral muscles.

The principles of this invention are particularly suited to application in a universal type exercising device—one having several different types of exercising stations on a single stand. Several air reservoirs can be accommodated in the frame of the device, each with its own guage and control valve, but supplied from a single compressor. One reservoir can serve a single exercise station, but if the effort required at two stations were about equal, e.g., the effort for a bench press station and an overhead press station, then one reservoir might serve two or more stations. A principal advantage of the universal setup of this invention as compared to a conventional one having dead weights is that its total weight is very substantially less as it has no dead weights. It can then therefore be more safely used in buildings where the floor loading may be critical or limiting.

What is claimed is:

1. A pneumatic exercise device comprising:

a. a frame having a base supporting an upright elongate hollow support member which support member has therein an integral airtight accumulator of fixed capacity;

b. an external bracket supported by said support member and being adjustable in position along the length thereof;

c. a lever arm pivotally mounted to said bracket for rotation thereabout in a plane of the longitudinal axis of said support member, one end of said lever having means to be grasped by the user of said device;

d. a pneumatic cylinder including a piston and piston rod, one end of which cylinder is pivotally mounted to said lever arm and acts thereagainst, the capacity of said pneumatic cylinder being less than 1/30th of the capacity of said airtight accumulator;

e. a length of flexible conduit connecting the compression slide of said pneumatic cylinder with said accumulator; and f. a pump adapted to compress and admit ambient air to said accumulator and permitting the pressure in such accumulator to be controllably increased.

2. The device of claim 1 including a bleed valve for controllably exhausting air from said reservoir.

3. The device of claim 1 wherein said lever arm extends to either side of the pivot point thereof and ends in a handle on the end of the arm opposite the arm to which said pneumatic cylinder is attached.

4. The device of claim 3 wherein the other end of said pneumatic cylinder is pivotally attached to said support member and is adapted to compress upon the upward movements of said handle.

5. The device of claim 4 as a bench press and having an asssociated bench adapted to accommodate an operator in a supine position.

6. The device of claim 3 wherein the point of attachment of said pneumatic cylinder to said lever arm can be changed along the length thereof to vary the stroke of said pneumatic cylinder.

* * * * *